US010405635B2

(12) United States Patent
Ramet et al.

(10) Patent No.: US 10,405,635 B2
(45) Date of Patent: Sep. 10, 2019

(54) CAP WITH APPLICATOR AND PACKAGING EQUIPPED WITH SAME

(71) Applicant: L'OREAL, Paris (FR)

(72) Inventors: Marc Ramet, Tokyo (JP); Marc Lechanoine, Tokyo (JP)

(73) Assignee: L'OREAL, Paris (FR)

( * ) Notice: Subject to any disclaimer, the term of this patent is extended or adjusted under 35 U.S.C. 154(b) by 239 days.

(21) Appl. No.: 15/525,076

(22) PCT Filed: Nov. 4, 2015

(86) PCT No.: PCT/JP2015/081912

§ 371 (c)(1),
(2) Date: Oct. 4, 2017

(87) PCT Pub. No.: WO2016/076406

PCT Pub. Date: May 19, 2016

(65) Prior Publication Data

US 2017/0318937 A1 Nov. 9, 2017

(30) Foreign Application Priority Data

Nov. 10, 2014 (JP) ..... 2014-227917

(51) Int. Cl.
*A45D 34/04* (2006.01)
*B65D 47/42* (2006.01)
*A45D 40/26* (2006.01)

(52) U.S. Cl.
CPC ..... *A45D 34/045* (2013.01); *A45D 40/265* (2013.01); *B65D 47/42* (2013.01)

(58) Field of Classification Search
CPC ..... A45D 34/045; A45D 40/265; B65D 47/42
USPC ..... 401/256
See application file for complete search history.

(56) References Cited

U.S. PATENT DOCUMENTS 1,021,709 A * 3/1912 Snow ..... A45D 40/265 15/257.05
1,534,259 A 4/1925 Dempsey
2,724,849 A 11/1955 Schultz
3,756,732 A * 9/1973 Stoffler ..... B65D 47/42 401/202

(Continued)

FOREIGN PATENT DOCUMENTS

DE 202005007550 U1 9/2005
EP 1029799 A1 8/2000

(Continued)

OTHER PUBLICATIONS

International Search Report and Written Opinion for PCT/JP2015/081912, dated Feb. 25, 2016.

*Primary Examiner* — Huyen D Le
(74) *Attorney, Agent, or Firm* — The Marbury Law Group, PLLC

(57) ABSTRACT

The present invention is related to a cap with applicator (30) that is attached to a container (10) which accommodates a formula. The cap (30) is capable of plugging an opening of a nozzle (14) for discharging the formula provided into the container (10) to the outside. The cap (30) includes an applicator (20) for applying the formula, and the applicator (20) is placed in a state in which it is isolated from the formula so that it does not contact the formula within the container (10) when the cap (30) is attached to the container (10).

13 Claims, 21 Drawing Sheets

(56) References Cited

U.S. PATENT DOCUMENTS

| | | | | |
|---|---|---|---|---|
| 4,674,903 | A | 6/1987 | Chen | |
| 4,832,060 | A | 5/1989 | Kingsford | |
| 6,305,863 | B1 * | 10/2001 | Gueret | A45D 34/045 401/126 |
| 6,309,124 | B1 | 10/2001 | Gueret | |
| 2002/0038661 | A1 | 4/2002 | Gueret | |
| 2002/0172541 | A1 * | 11/2002 | Gueret | A45D 34/045 401/130 |
| 2003/0034322 | A1 * | 2/2003 | Doherty | B65D 41/0478 215/228 |
| 2003/0075200 | A1 * | 4/2003 | Gueret | A45D 34/04 132/320 |
| 2003/0086742 | A1 | 5/2003 | Gueret | |
| 2006/0051153 | A1 * | 3/2006 | Delage | A45D 33/02 401/119 |
| 2007/0000566 | A1 | 1/2007 | Gueret | |
| 2010/0143021 | A1 * | 6/2010 | De Laforcade | A45D 33/00 401/129 |
| 2012/0324655 | A1 | 12/2012 | Chawla et al. | |

FOREIGN PATENT DOCUMENTS

| | | | |
|---|---|---|---|
| EP | 1253089 | A1 | 10/2002 |
| EP | 1304057 | A2 | 4/2003 |
| FR | 2788501 | A1 | 7/2000 |
| FR | 2789660 | A1 | 8/2000 |
| FR | 2814444 | A1 | 3/2002 |
| FR | 2885779 | A1 | 11/2006 |
| GB | 174983 | A | 2/1922 |
| KR | 20120034864 | A | 4/2012 |
| WO | 00/09417 | A2 | 2/2002 |

* cited by examiner

CAP WITH APPLICATOR AND PACKAGING EQUIPPED WITH SAME

CROSS REFERENCE TO RELATED APPLICATIONS

This is a national stage application of PCT/JP2015/081912, filed internationally on Nov. 4, 2015, which claims priority to Japanese Application No. 2014-227917, filed on Nov. 10, 2014, both of which are incorporated by reference herein in their entireties.

TECHNICAL FIELD

The present invention relates to a cap with applicator, and more specifically to a cap with applicator for use in applying formulas. The present invention further relates to a packaging equipped with such a cap.

BACKGROUND ART

Various packages including a cap to which an applicator for applying formulas such as a cosmetic product is attached have been proposed. In such a packaging, when stored or not in use, at least the tip of the applicator is submerged in the formula accommodated within a container such as a bottle.

During use, first, a user removes the cap from the container. Next, the user applies the formula adhered to the applicator to a desired area by operating the cap. Such a packaging is simple, but presents a disadvantage in that the user cannot easily regulate the amount of the formula to be applied during use. In order to overcome this problem, a packaging in which the applicator is directly attached to a container such as a tube or bottle has been proposed.

This kind of packaging is easy to use; however, it presents the following disadvantages. First, dosing out only a certain amount of the formula is not user friendly as the formula often becomes overloaded on the applicator because the user cannot see the flow of the formula. Second, it is difficult to ensure the tightness in such a packaging. A large number of pieces are necessary to ensure the tightness, and this leads to increases in the manufacturing costs of the packaging. Third, in such a packaging, it is difficult to guarantee that formula which has dried out and solidified is not returned into the container such as a bottle.

Further conventional packagings for formulas are disclosed in the following documents.

FR2788501 and FR2789660 disclose a self-loading packaging including a pump and a specific chamber for loading a formula into a sponge by directly pushing the pump. FR2814444 discloses a self-loading packaging including a container and a cap equipped with an applicator on a hinge. U.S. Pat. No. 1,534,259 discloses a self-loading packaging including an applicator between a cap and a container.

FR2885779 discloses a packaging including a container to which a sponge applicator is attached and a massage tool. GB174983 and U.S. Pat. No. 4,674,903 disclose a packaging including a container and a sponge head attached to the periphery of a central tube that extends from the container. In the packagings disclosed in FR2885779, GB174983, and U.S. Pat. No. 4,674,903, the applicator is attached on the container side.

U.S. Pat. No. 4,832,060 discloses a packaging in which an applicator, i.e. a brush, is attached on a cap side. In this packaging, the brush is submerged in a formula such as a nail polish when not in use.

DISCLOSURE OF INVENTION

An object of the present invention is to provide a cap with applicator for applying formulas which has been improved to ameliorate or overcome the disadvantages of the prior art, as well as a packaging equipped with such a cap.

In order to achieve the above-mentioned object, the present invention provides a cap with applicator that is attached to a container in which a formula is accommodated. According to the present invention, the cap can plug an opening of a nozzle for discharging the formula to the outside that is provided on the container. The cap is equipped with an applicator for applying the formula, and the applicator is placed in a state in which it is isolated from the formula so that it does not contact the formula within the container when the cap is attached to the container. When this cap with applicator is used, the formula within the container is loaded onto the applicator by a user, and then the user operates the cap to apply the formula to a desired area.

Further, the present invention provides a packaging equipped with the above-described cap and a container to which the cap is attached, the container including a nozzle for discharging the formula that is accommodated therewithin to the outside.

Advantageously, the cap with applicator and the packaging according to the present invention provide a simple, easy to use, inexpensive, and hygienic solution. In further detail, according to the present invention, the user can completely regulate the amount of the formula to be loaded onto the applicator. Further, the user can load the formula on only a selected area, and this means that the present invention is user friendly. Also, according to the present invention, the applicator can be quickly washed and dried after use, and this means that the present invention is hygiene friendly. In addition, the present invention can be realized with a small number of components and can be reused in other versions, and this means that the present invention is cost effective.

The formula is preferably a fluent formula. The fluent formula is preferably a formula having a viscosity of less than or equal to 1000 Pa·s, more preferably less than or equal to 500 Pa·s, at 25° C. The fluent formula may be in a form of liquid, semi-solid, or gel at 25° C. As the fluent formula accommodated within the container, mention may be made of the following, although the fluent formula is not limited thereto: various cosmetic products including BB (blemish balm) cream, blush, concealer, lip paint, eye cream, and foundation such as liquid foundation and cream foundation; cleansing products; make up products; make up remover products; and hair products such as hair dye.

According to another embodiment of the present invention, the applicator can be attached to the cap such that is can be separated from the cap.

The container can include a collar surrounding the nozzle. In this case, when the cap is attached to the container, at least a portion of the applicator can be accommodated within a space defined by the collar. In a particularly preferred embodiment, the outer peripheral surface of the applicator fits closely to the inner peripheral surface of the collar.

The applicator can include a hole which receives at least a portion of the nozzle when the cap is attached to the container.

The outer peripheral surface of the nozzle can include screw threads, and the cap can include a portion on which screw threads that engage with the screw threads of the nozzle are formed. In this case, when the cap is attached to the container, the screw threads of the nozzle can engage with the screw threads of the cap after the portion on which screw threads are formed in the nozzle has passed the hole.

The applicator can have a circular cross-section, or non-circular cross-section including an elliptical cross-section, a substantially triangular cross-section, a substantially square cross-section, and a substantially polygonal cross-section having five or more sides. The cross-section area of the applicator can decrease from the base side thereof toward the tip side thereof along a center axis of the cap. Further, the applicator can have an application surface that is inclined relative to the center axis of the cap.

The applicator can be made of at least one material selected from rubber, soft or hard plastic, sponge, and foam. The applicator itself can be made of a solid formula. The applicator can be a brush. The applicator can include a plurality of fins with spaces formed between the fins for retaining a formula. In this case, in particular, absorbent blocks are disposed between adjacent fins in order to receive the formula and retain the formula therewithin. The applicator can be a spatula. Further, the applicator can be a delimited area of the cap.

BRIEF DESCRIPTION OF THE DRAWINGS

The present application can be better understood upon a careful reading of the following explanations regarding non-limiting, representative embodiments of the present invention while referring to the attached drawings.

BEST MODE FOR CARRYING OUT THE INVENTION

FIGS. 1 to 4 illustrate one embodiment of a cap with applicator and a packaging according to the present invention. A packaging 1 shown in these drawings includes a tube-shaped container 10 in which a formula, such as a cleansing product, is accommodated, and a cap (cap with applicator) 30 equipped with an applicator 20 used for applying the formula.

Figure 1:
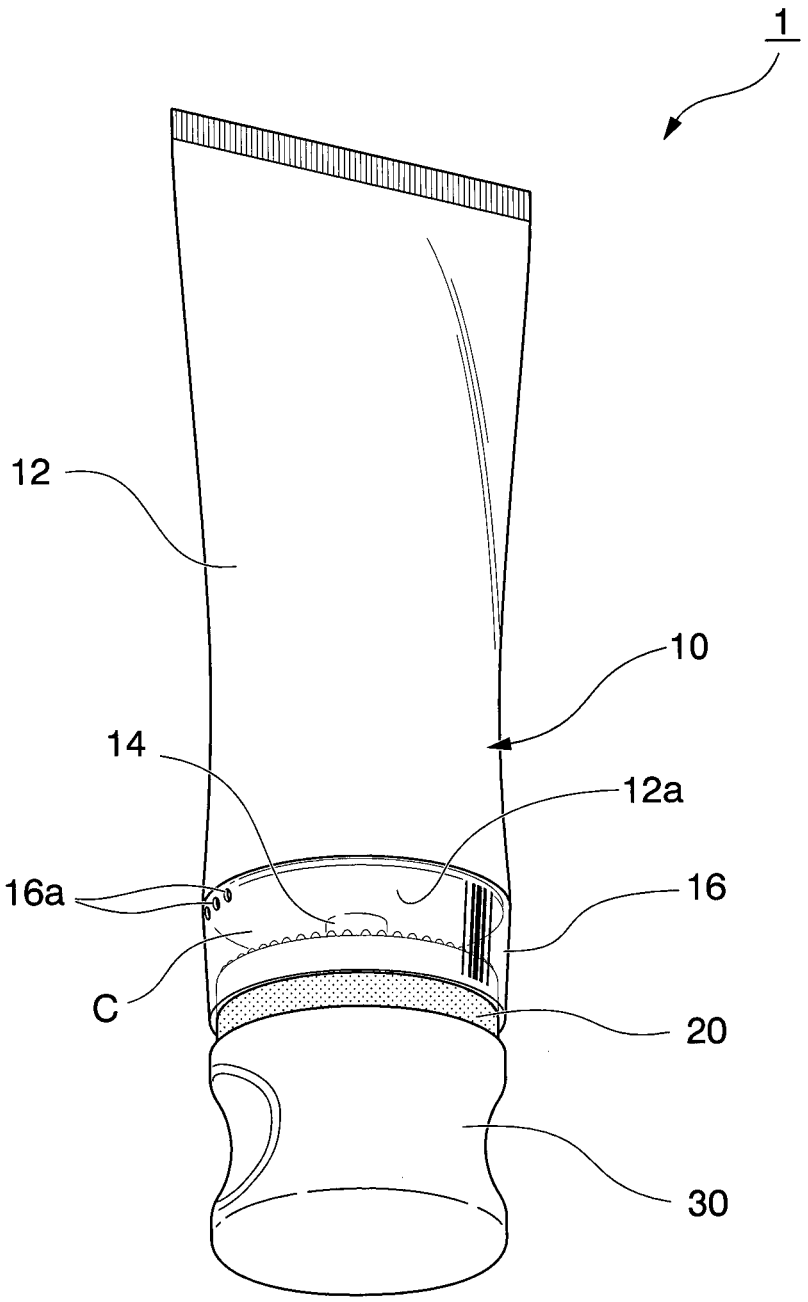
FIG. 1 is a perspective view of one embodiment of a packaging according to the present invention, in which a cap with applicator is attached to a container.
Figure 2:
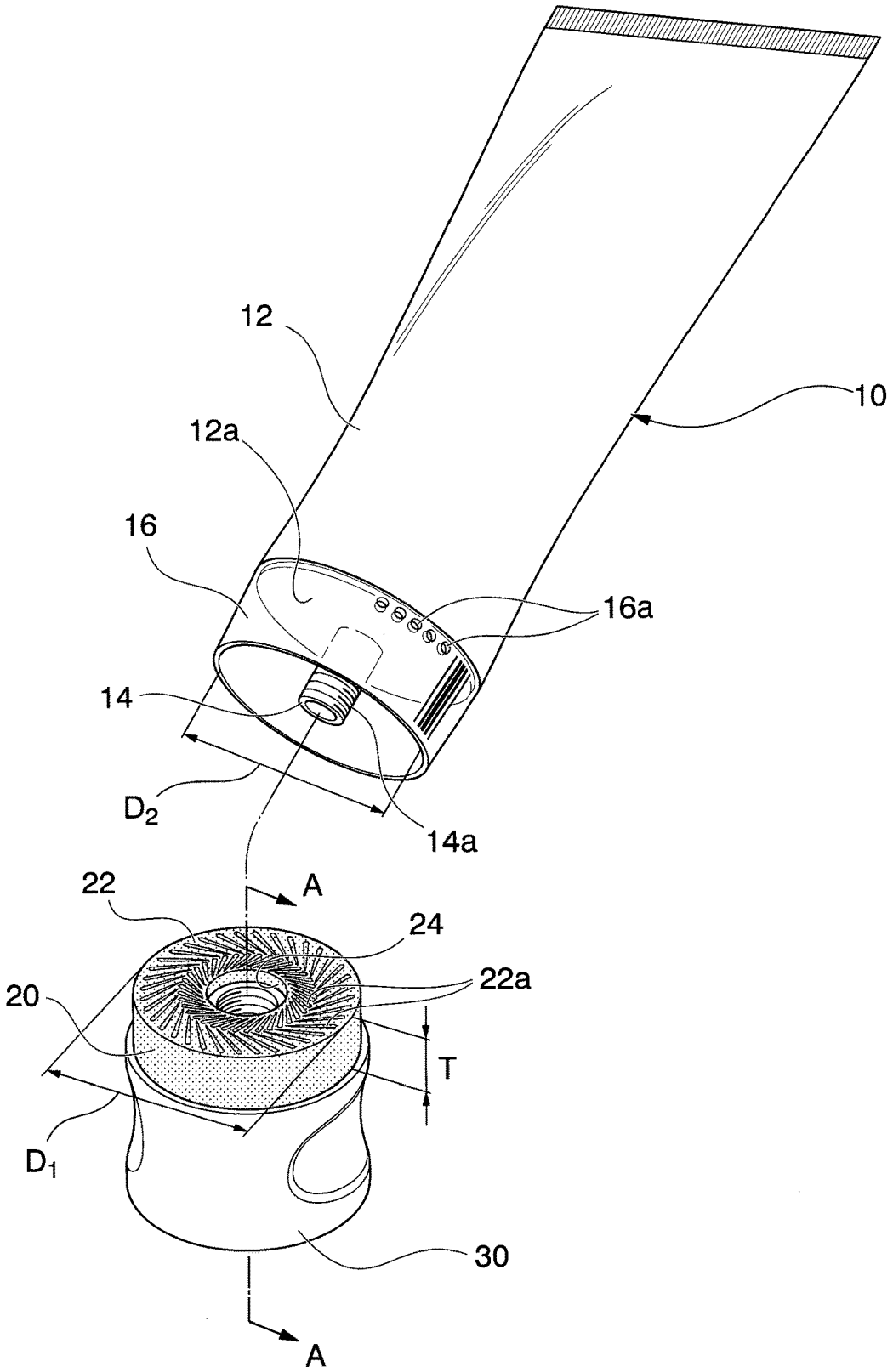
FIG. 2 illustrates the packaging shown in FIG. 1 in a state in which the cap with applicator is separated from the container.

When stored or not in use as shown in FIG. 1, the cap 30 is removably attached to the container 10 by screwing as will be explained later. In this state, the applicator 20 is placed in a state in which it is isolated from the formula so that it does not contact the formula within the container 10.

In the illustrated embodiment, the container 10 includes a main body 12 formed from a soft plastic, a nozzle 14 for discharging the formula within the main body 12 to the outside, and a cylindrical collar 16 that surrounds the nozzle 14 and is fixed to the main body 12.

The nozzle 14 is integrally formed on the container main body 12, and further includes screw threads **14*a* on its outer peripheral surface thereof. When stored or not in use as shown in FIG. 1, the cap 30 plugs the opening of the nozzle 14**.

The collar 16 is formed from a plastic that is more hard than the material that forms the container main body 12. The collar 16 includes a plurality of through holes **16*a*. In this embodiment, the collar 16 is formed from a transparent plastic. However, the collar 16** can be formed from a semitransparent or opaque plastic, or from a metal material.

In the illustrated embodiment, the applicator 20 is formed from, for example, rubber, and is particularly realized as a "scrubber". As can be understood from FIG. 2 which illustrates a state in which the cap 30 is removed from the container 10, a plurality of ridges **22*a* are advantageously formed in a spiral pattern on an application surface 22 of the applicator 20** in order to whip up the cleansing product and softly cleanse the skin.

In the illustrated embodiment, the applicator 20 has a circular cross-section. A diameter $D_1$ (FIG. 2) of the applicator 20 is generally constant with regard to the thickness direction of the applicator 20. Further, the diameter $D_1$ of the applicator 20 is smaller but close to an inner diameter $D_2$ (FIG. 2) of the collar 16. Therefore, as shown in FIG. 1, in a state in which the applicator 20 is accommodated within a space defined by the collar 16, the outer peripheral surface of the applicator 20 fits closely to the inner peripheral surface of the collar 16.

In the illustrated embodiment, the applicator 20 is provided as a separate member from the cap 30. In other words, the applicator 20 is removably joined to the cap 30 in a clip style to be explained below. Therefore, as shown in FIG. 3, the applicator 20 can be separated from the cap 30 as necessary.

Figure 3:
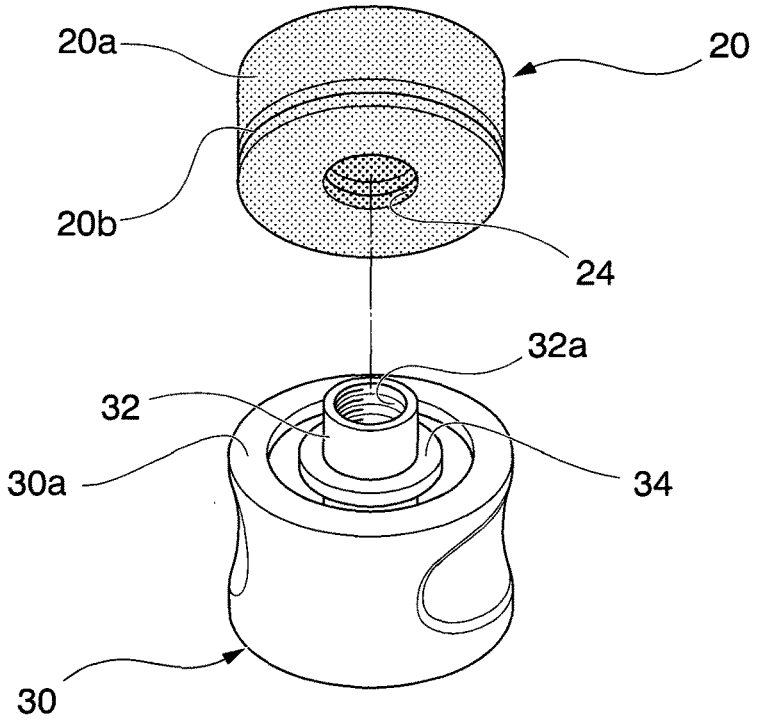
FIG. 3 illustrates the cap with applicator shown in FIG. 2 in a state in which the applicator is separated from the cap.
Figure 4:
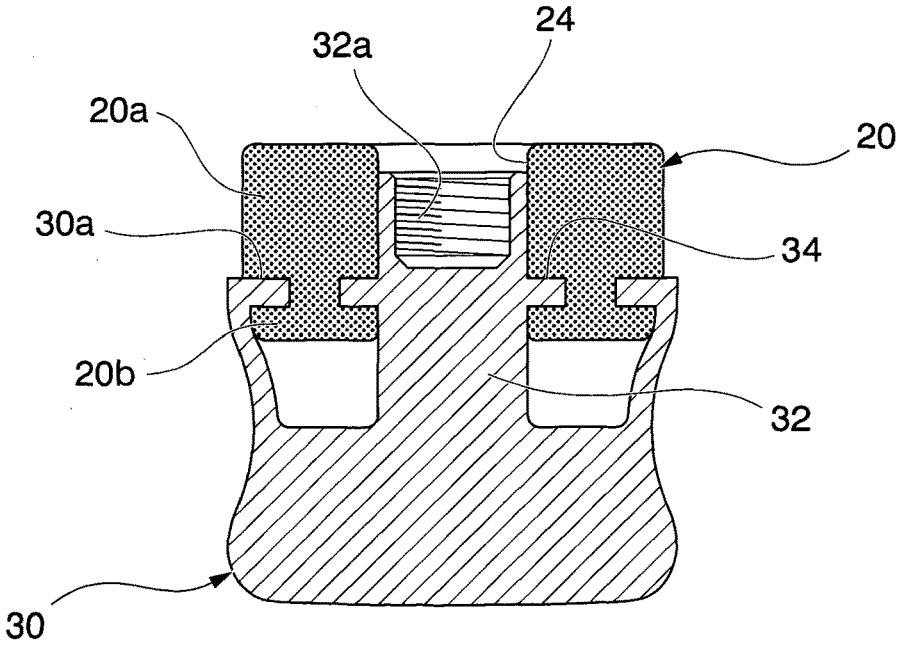
FIG. 4 illustrates a cross-section of the cap along line A-A shown in FIG. 2.

As can be understood from FIG. 3 which illustrates a state in which the applicator 20 is separated from the cap 30, a through hole 24 is formed in the center of the applicator 20. Meanwhile, a cylindrical boss 32 is formed in the center of the cap 30. The boss 32 protrudes from the opening surface of the cap 30 with a height that is shorter than a thickness T (FIG. 2) of the applicator 20. The boss 32 is equipped with screw threads 32*a* corresponding to the screw threads 14*a* of the nozzle 14 on its inner peripheral surface. The boss 32 further includes a circular flange 34 at the same height as the opening surface of the cap 30. In a state in which the applicator 20 is joined to the cap 30, the boss 32 of the cap 30 is inserted into the through hole 24 of the applicator 20 as shown in the cross-section illustrated in FIG. 4. In addition, in this state, the flange 34 of the boss 32 and a rim 30*a* on the opening side of the cap 30 are sandwiched between a main body portion 20*a* and a thin bottom portion 20*b* of the applicator 20.

When the cap 30 is attached to the container 10, the screw threads 14*a* of the nozzle 14 engage with the screw threads 32*a* of the boss 32 after the nozzle 14 of the container 10 has passed through the through hole 24 of the applicator 20. In the state shown in FIG. 1 in which the cap 30 is screwed up to its final position, an opening 14*b* of the nozzle 14 is plugged by a bottom surface of the boss 32. Thus, in this state, the formula within the container 10 has no contact with the outside air.

In the illustrated embodiment, in the state shown in FIG. 1 in which the cap 30 is screwed up to its final position, a gap C is formed between the application surface 22 of the applicator 20 and an edge surface 12*a* of the container main body 12. This gap C realizes air circulation for quickly drying the applicator 20. In other words, the applicator 20 dries quickly even if the applicator 20 is immediately attached to the container 10 after washing it with water.

When using the above-described packaging for a cleansing product, the user first twists the cap 30 to loosen it and then separates the cap 30 together with the applicator 20 which is joined thereto from the container 10. Next, the user loads a necessary amount of the cleansing product within the container 10 onto the application surface 22 of the applicator 20 by squeezing the container main body 12. Subsequently, the user operates the cap 30 to apply the cleansing product loaded onto the applicator 20 to a desired area.

In this embodiment, the cap 30 can be removed from the applicator 20. Therefore, after use, the applicator 20 can be washed by itself to remove any product remaining on the application surface 22 of the applicator 20. Thus, compared to a conventional packaging in which an applicator is directly attached to a container, the applicator is remarkably easy to wash. In particular, in such a conventional packaging, the product within the container may deteriorate due to contact with water when cleaning the applicator, but this possibility is completely eliminated in the present embodiment.

Figure 5:
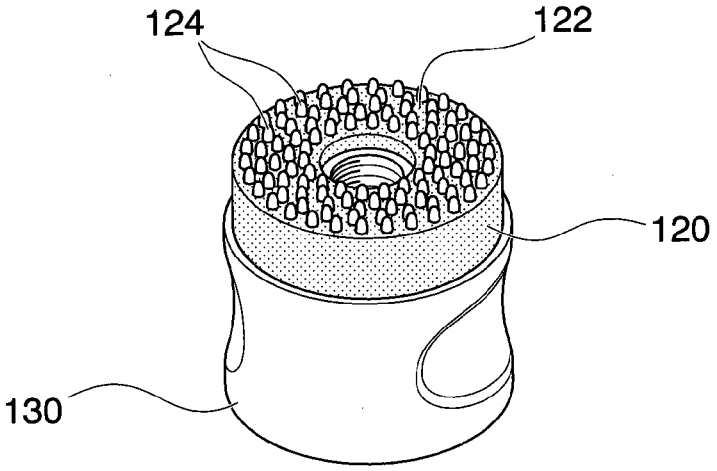
FIGS. 5 to 7 are perspective views of several alternative embodiments of the cap with applicator shown in FIGS. 1 to 4.
Figure 6:
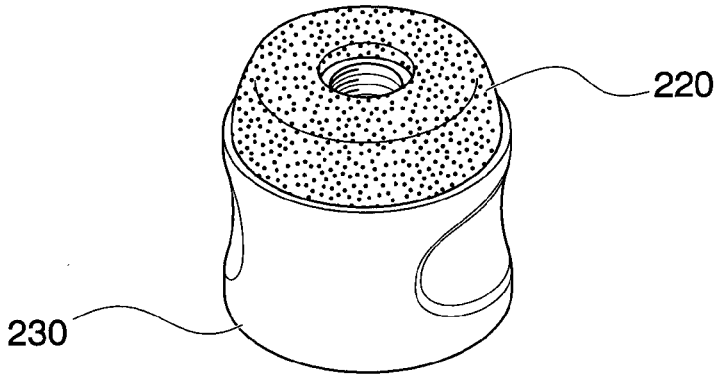
Figure 7:
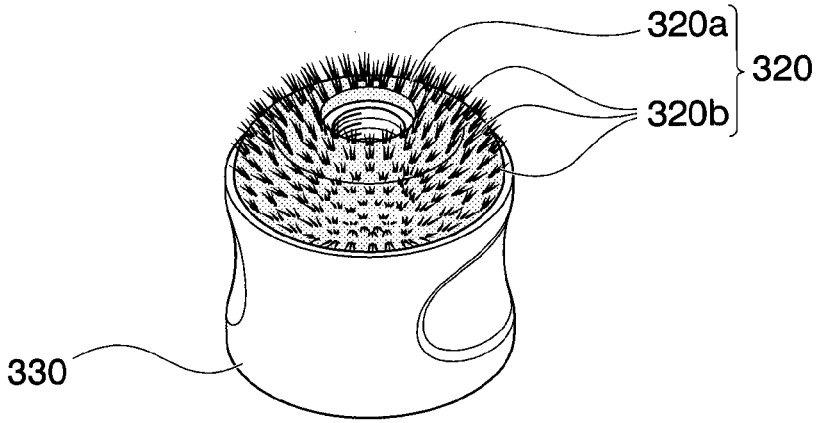

FIGS. 5 to 7 illustrate alternative embodiments of the cap with applicator according to the present invention. These alternative caps can be used instead of the cap with applicator explained referring to FIGS. 1 to 4.

A cap with applicator 130 shown in FIG. 5 has the same basic structure as the cap with applicator 30 explained referring to FIGS. 1 to 4. This cap 130 can also be applied to a packaging for, for example, a cleansing product. However, the cap with applicator 130 differs from the cap with applicator 30 shown in FIGS. 1 to 4 in that a plurality of pimples 124 are formed on an application surface 122 of an applicator 120.

A cap with applicator 230 shown in FIG. 6 differs from the cap with applicator 30 shown in FIGS. 1 to 4 in that an applicator 220 is made almost entirely of sponge. The cap with applicator 230 shown in FIG. 6 can applied to a packaging for, for example, a makeup remover.

A cap with applicator 330 shown in FIG. 7 differs from the cap with applicator 30 shown in FIGS. 1 to 4 in that an applicator 320 includes a substantially semispherical applicator main body 320*a* and a plurality of spines 320*b* that extend from the surface of the applicator main body 320*a*. The applicator main body 320*a* and the spines 320*b* are integrally molded using a material such as a soft plastic.

The above-described applicators can be realized in various forms using various materials. As an example of such materials, mention may be made of rubber, soft plastic, hard plastic, sponge, foam, and the like. Further, the applicator can be made of a combination of different materials. By using an applicator made in this way, it is possible to achieve usages such as gradation or blurred effects which were conventionally difficult to achieve.

Hereinafter, various alternative embodiments of the packaging according to the present invention will be further explained referring to FIGS. 8 to 21.

Figure 8:
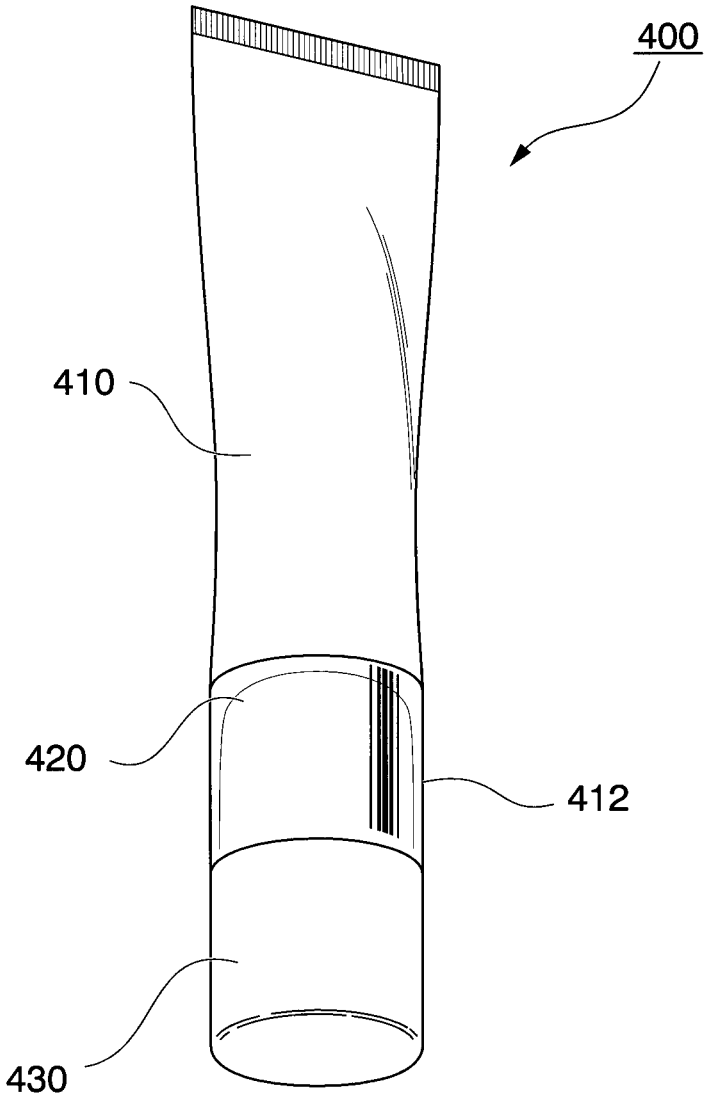
FIG. 8 is a perspective view of an alternative embodiment of the packaging according to the present invention, in which a cap with applicator is attached to a container.
Figure 9:
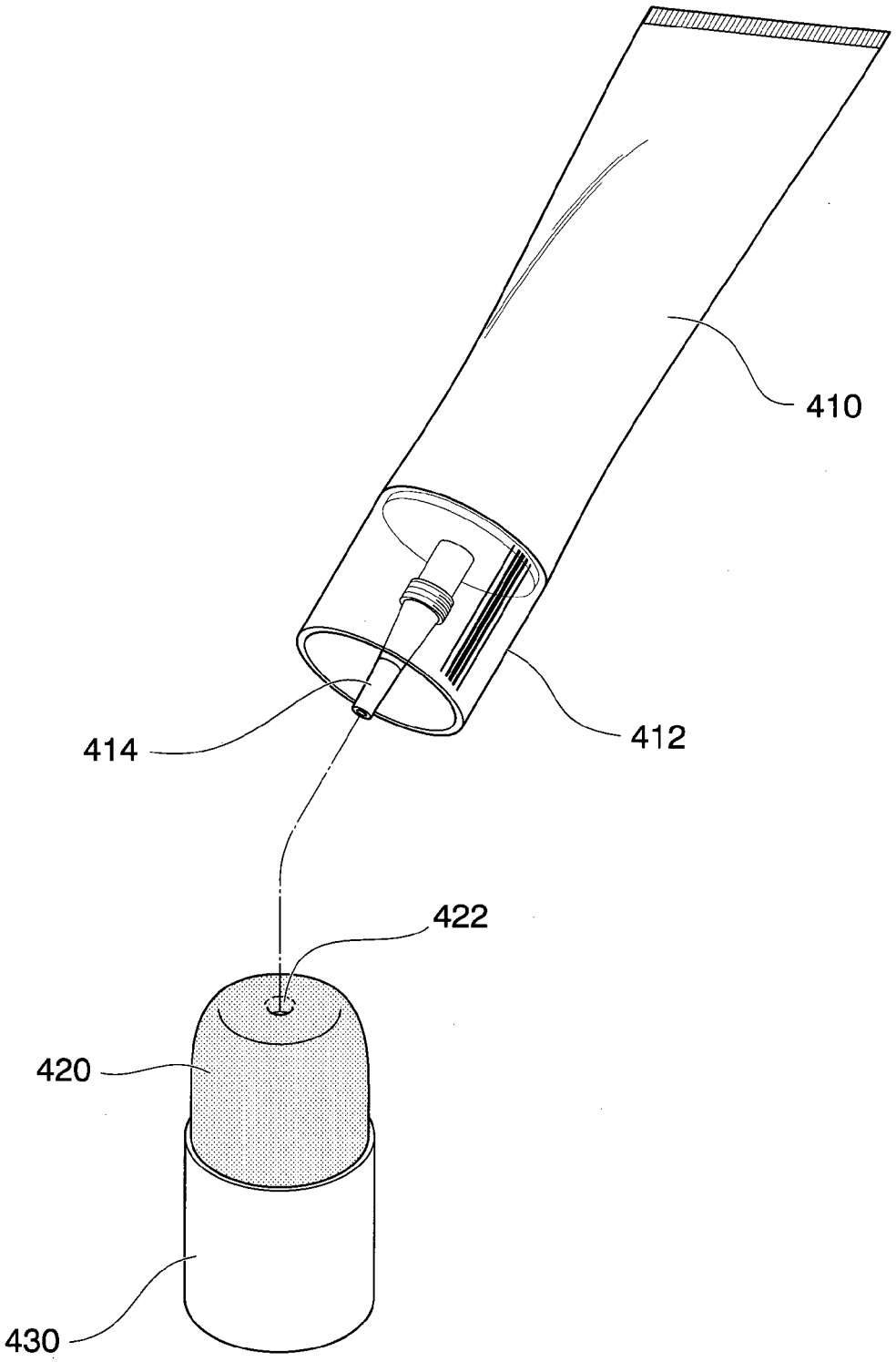
FIG. 9 illustrates the packaging shown in FIG. 8 in a state in which the cap with applicator is separated from the container.

FIGS. 8 and 9 illustrate an alternative embodiment of the present invention related to a packaging for a BB (blemish balm) cream during storage (non-use) and during use. A packaging 400 shown in FIGS. 8 and 9 includes a tube-shaped container 410 in which a BB cream is accommodated and a cap 430 equipped with an applicator 420 used to apply the BB cream. The container 410 includes a cylindrical collar 412 that can accommodate the applicator 420.

The applicator 420 is flocked across its entire surface. Therefore, the applicator 420 can be referred to as a "flocked tip". As shown in FIG. 9, the applicator 420 includes a hole 422 for receiving a pin-shaped nozzle 414 that extends from the main body of the container 410. The applicator 420 has a circular cross-section. The diameter of the applicator 420 is substantially constant from its base side toward its tip side (application surface side).

During use, the user first separates the container 410 and the cap 430. Next, the user loads a desired amount of the BB cream onto the application surface of the applicator 420 by pushing the side surfaces of the container 410. After use, the cap 430 is attached to the container 410. Therein, the nozzle 414 is inserted into the hole 422 of the applicator 420. Further, screw threads formed on the nozzle 414 engage with corresponding screw threads (not illustrated) on the cap side by rotating the cap 430 in a tightening direction. Finally, the collar 412 and the applicator 420 as shown in FIG. 8 are put into a state in which they are completely fitted together. In the other embodiments to be explained below, the container and the cap are configured such that they can be joined together by screw engagement similar to the above embodiment. However, this configuration is not essential. The embodiment illustrated in FIGS. 8 and 9 can also be used for a foundation or blush.

Figure 10:
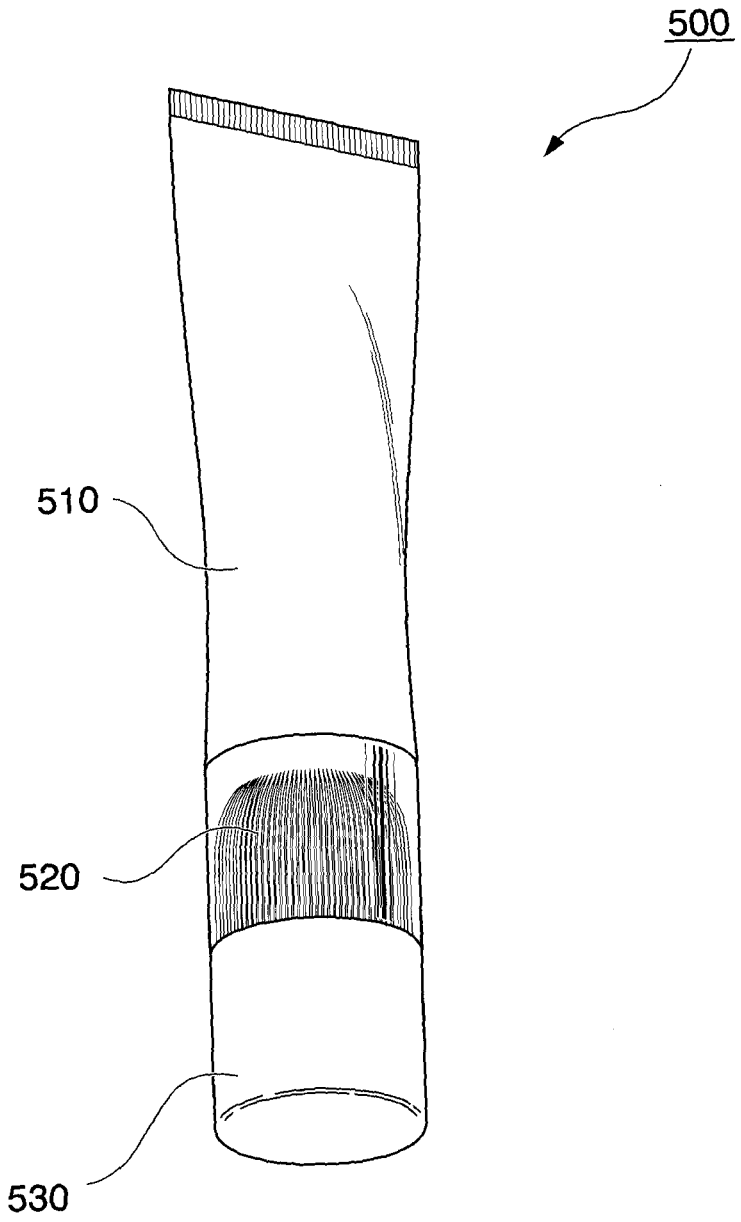
FIG. 10 is a perspective view of an alternative embodiment of the packaging according to the present invention, in which a cap with applicator is attached to a container.
Figure 11:
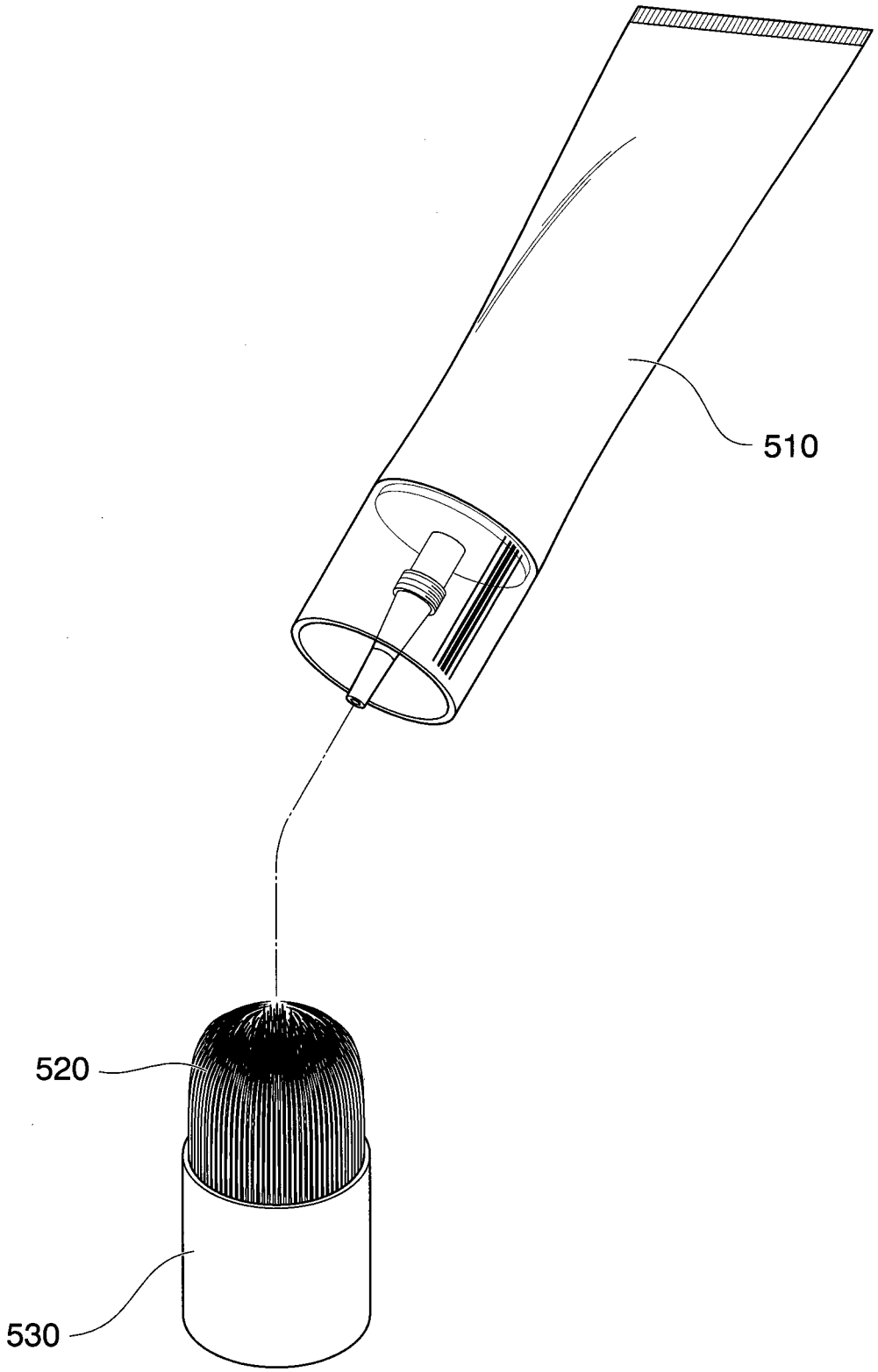
FIG. 11 illustrates the packaging shown in FIG. 10 in a state in which the cap with applicator is separated from the container.

FIGS. 10 and 11 also illustrate an alternative embodiment of the present invention related to a packaging for a BB cream during storage (non-use) and during use. A packaging 500 illustrated in FIGS. 10 and 11 includes a tube-shaped container 510 in which a BB cream is accommodated and a cap 530 equipped with an applicator 520 used to apply the BB cream.

The method of use of the packaging shown in FIGS. 10 and 11 is substantially the same as that of the embodiment shown in FIGS. 8 and 9. However, in this embodiment, unlike that in FIGS. 8 and 9, the applicator 520 is made of a bundle of a plurality of soft hairs, or in other words the applicator 520 is realized as a brush.

Figure 12:
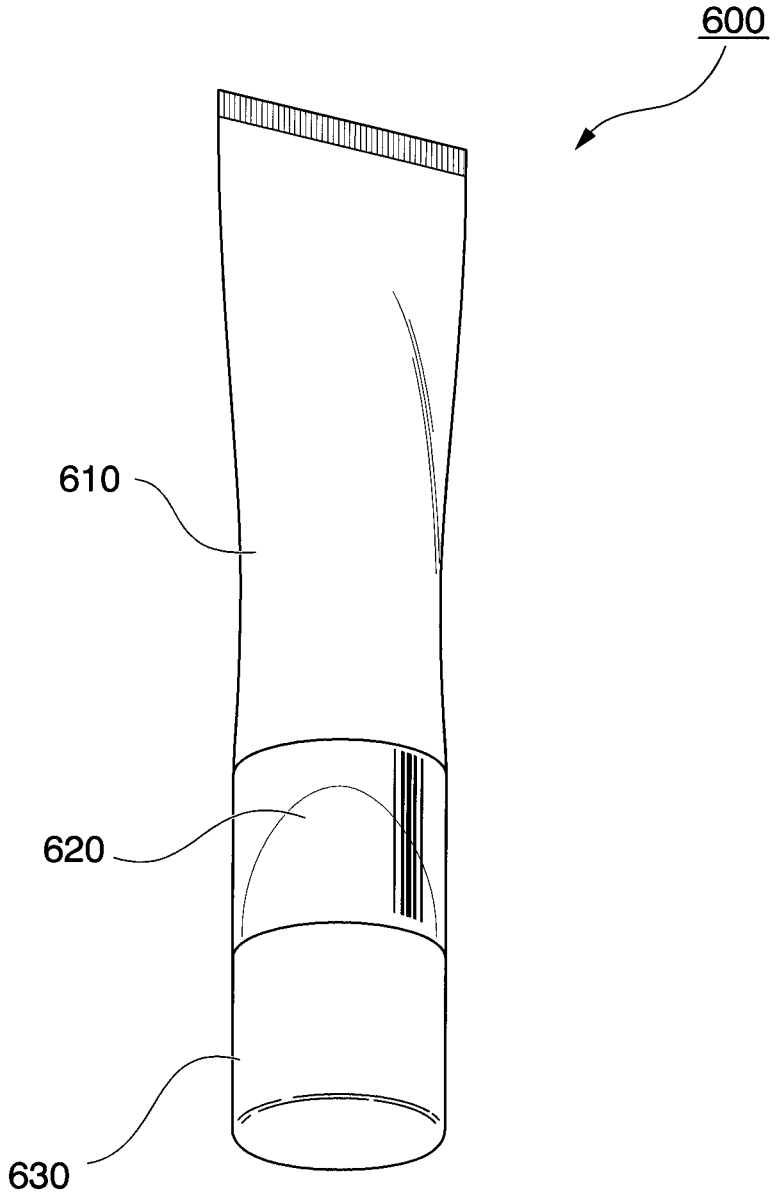
FIG. 12 is a perspective view of an alternative embodiment of the packaging according to the present invention, in which a cap with applicator is attached to a container.
Figure 13:
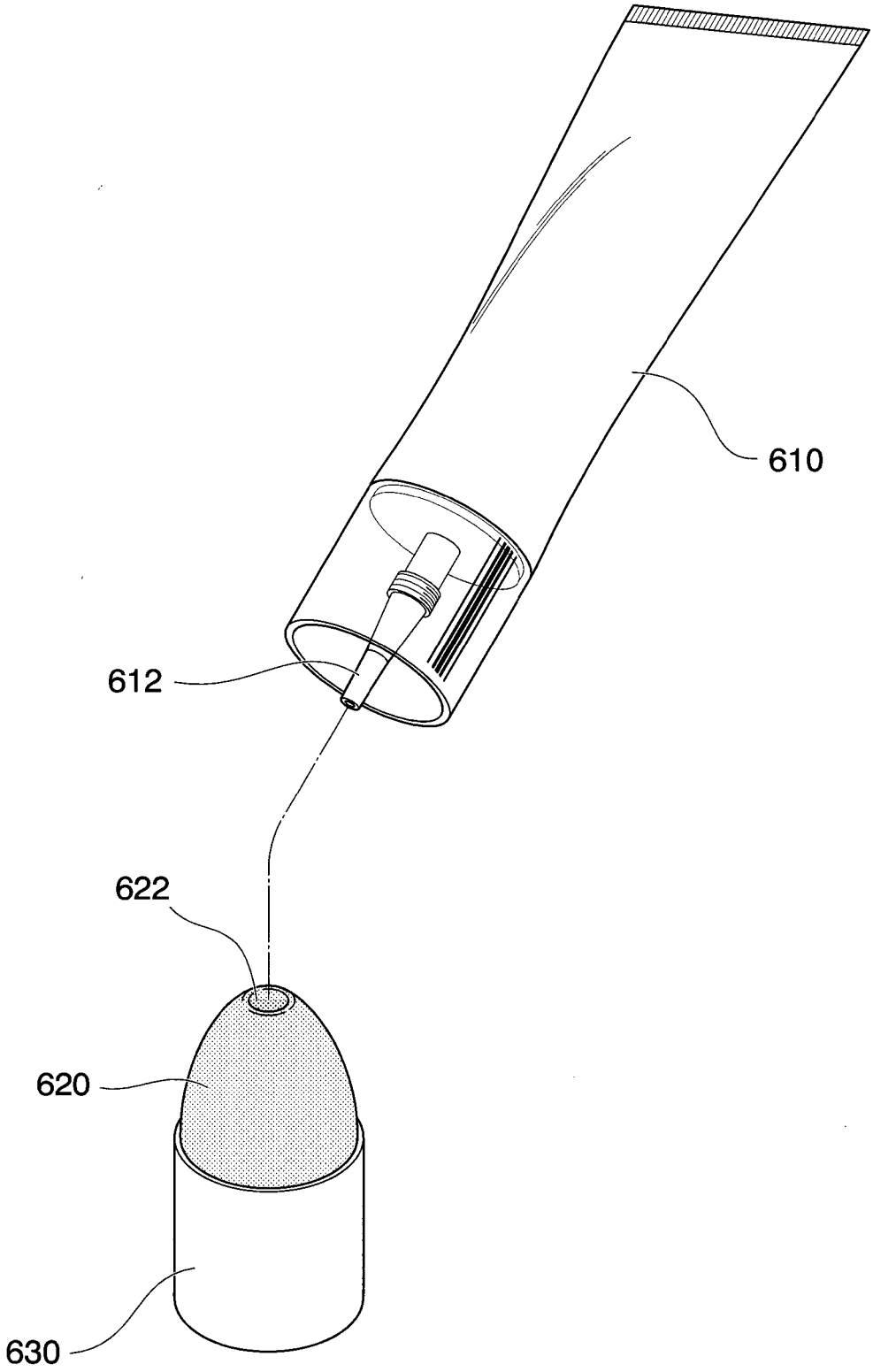
FIG. 13 illustrates the packaging shown in FIG. 12 in a state in which the cap with applicator is separated from the container.

FIGS. 12 and 13 illustrate an alternative embodiment of the present invention related to a packaging for a concealer during storage (non-use) and during use. A packaging 600 illustrated in FIGS. 12 and 13 includes a tube-shaped container 610 in which a concealer is accommodated and a cap 630 equipped with an applicator 620 used to apply the concealer.

Similar to the embodiment shown in FIGS. 8 and 9, the applicator 620 is flocked across its entire surface. As can be understood from FIG. 13, the applicator 620 includes a hole 622 for receiving a pin-shaped nozzle 612 of a container 610. The applicator 620 has a circular cross-section. However, unlike the embodiment shown in FIGS. 8 and 9, the diameter of this cross-section, and thus the cross-section area of the applicator 620, decreases from the base side of the applicator 620 toward the tip side (application surface side) thereof. The method of use of the packaging shown in FIGS. 12 and 13 is substantially the same as that of the embodiment shown in FIGS. 8 and 9.

In the above-described embodiments, applicators with a generally circular cross-section were explained. However, the cross-section of the applicator does not have to be circular. According to further alternative embodiments of the present invention, the applicator can have a non-circular cross-section including an elliptical cross-section, a substantially triangular cross-section, a substantially square cross-section, and a substantially polygonal cross-section having five or more sides.

Figure 14:
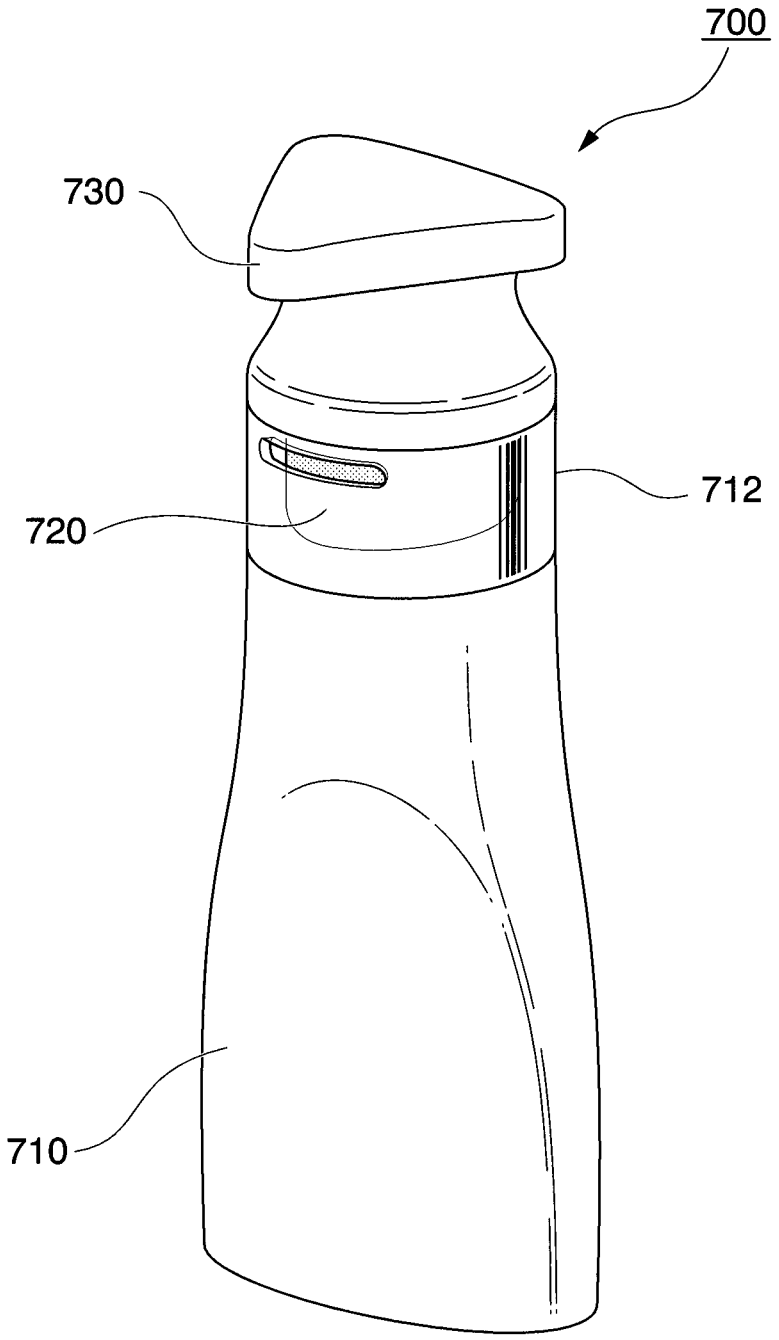
FIG. 14 is a perspective view of an alternative embodiment of the packaging according to the present invention, in which a cap with applicator is attached to a container.
Figure 15:
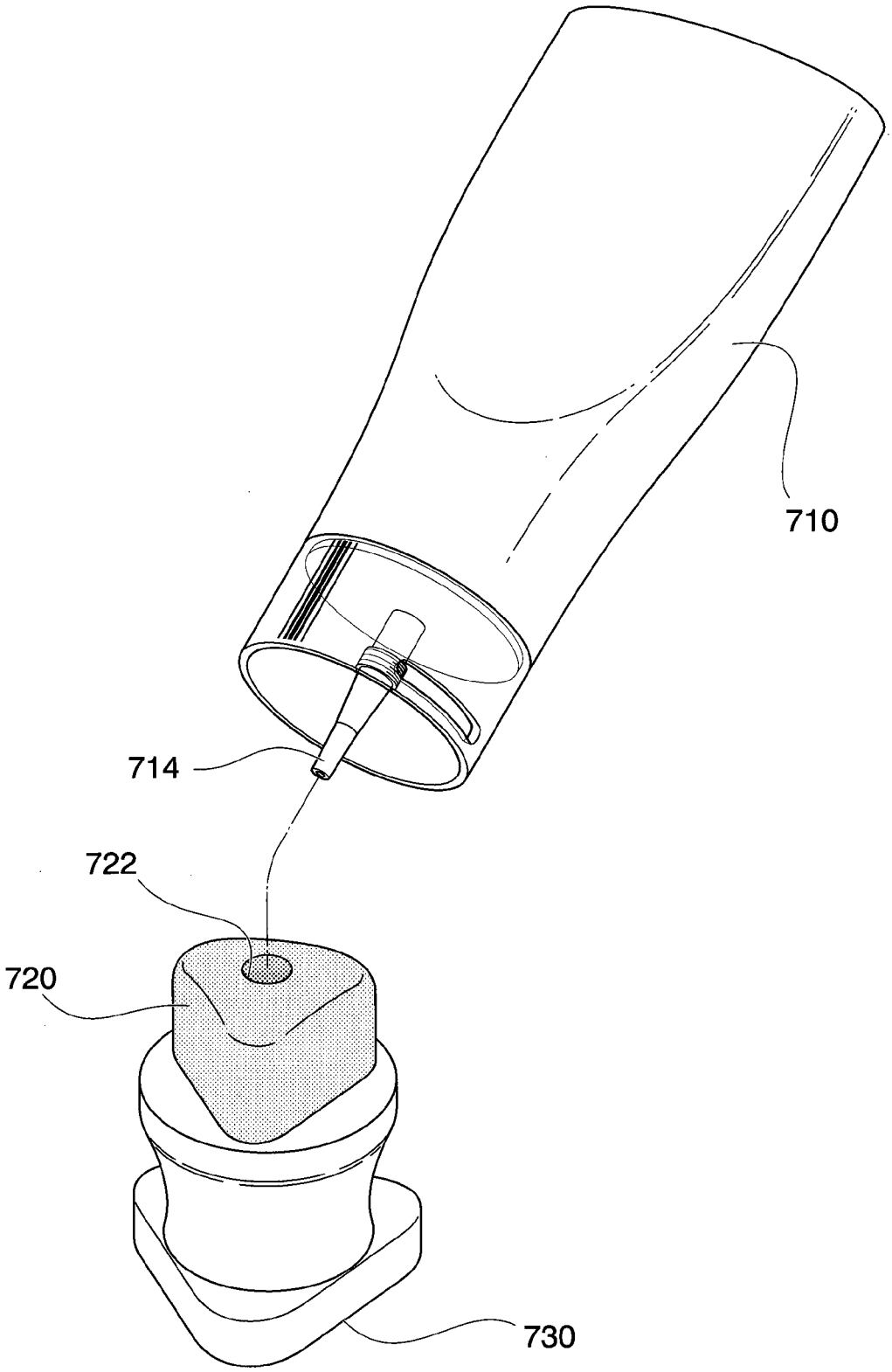
FIG. 15 illustrates the packaging shown in FIG. 14 in a state in which the cap with applicator is separated from the container.

FIGS. 14 and 15 illustrate an alternative embodiment of the present invention related to a packaging for a liquid foundation during storage (non-use) and during use. A packaging 700 illustrated in FIGS. 14 and 15 includes a bottle-shaped container 710 in which a foundation is accommodated and a cap 730 equipped with an applicator 720 used to apply the foundation. The container 710 further includes a cylindrical collar 712.

The applicator 720 is made of, for example, a sponge. The applicator 720 onto which the foundation within the container 710 is loaded by a user has a substantially triangular cross-section as can be understood from FIG. 15. The applicator 720 includes a hole 722 for receiving a pin-shaped nozzle 714 that extends from the container 710. The application 720 is attached to the cap 730 such that it can be easily removed from the cap 730 for washing after use. During storage, the nozzle 714 is screwed into the cap 730, and the applicator 720 is in a state in which it is completely fitted to the collar 712 of the container 710 as shown in FIG. 14.

Figure 16:
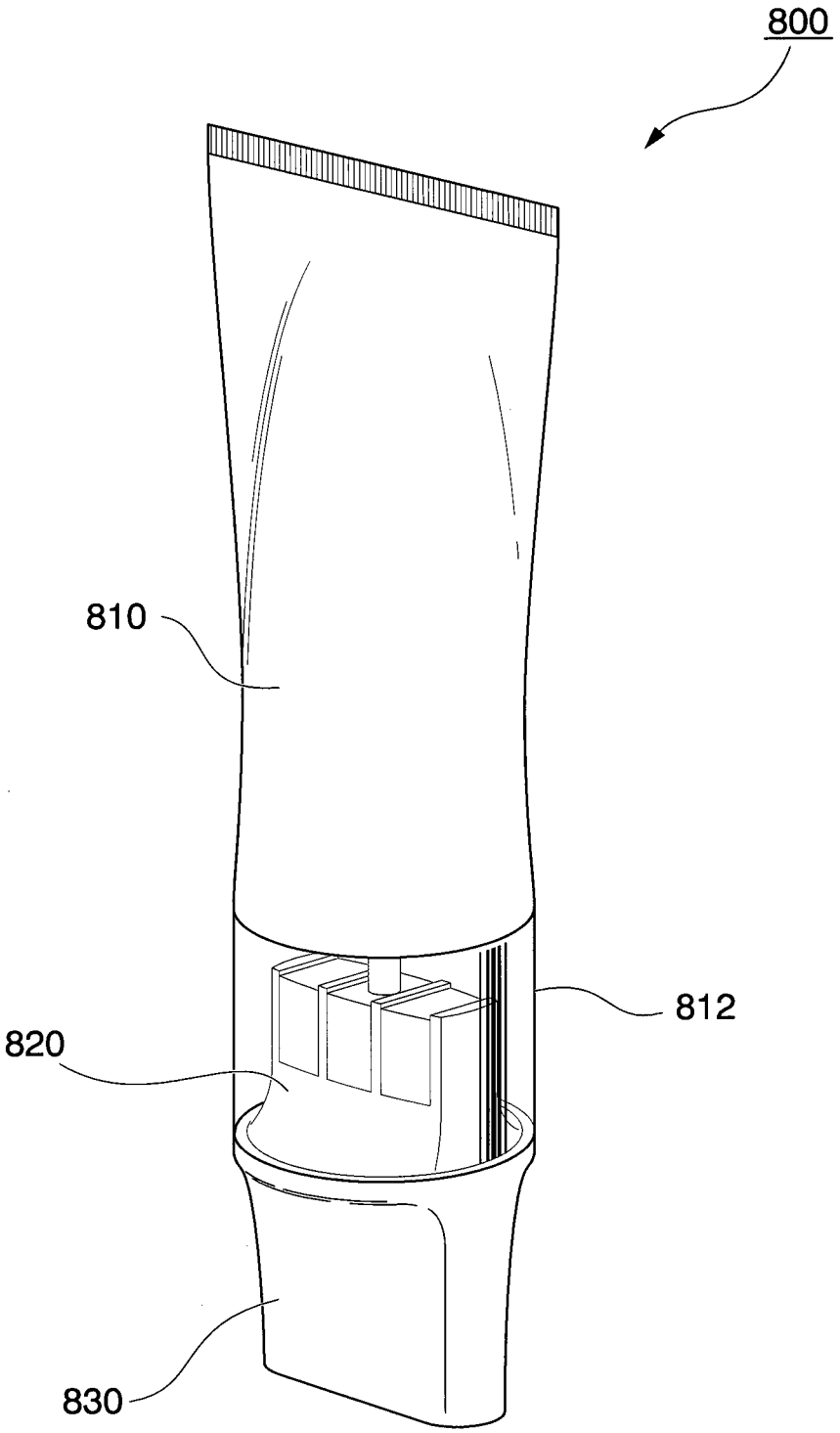
FIG. 16 is a perspective view of an alternative embodiment of the packaging according to the present invention, in which a cap with applicator is attached to a container.
Figure 17:
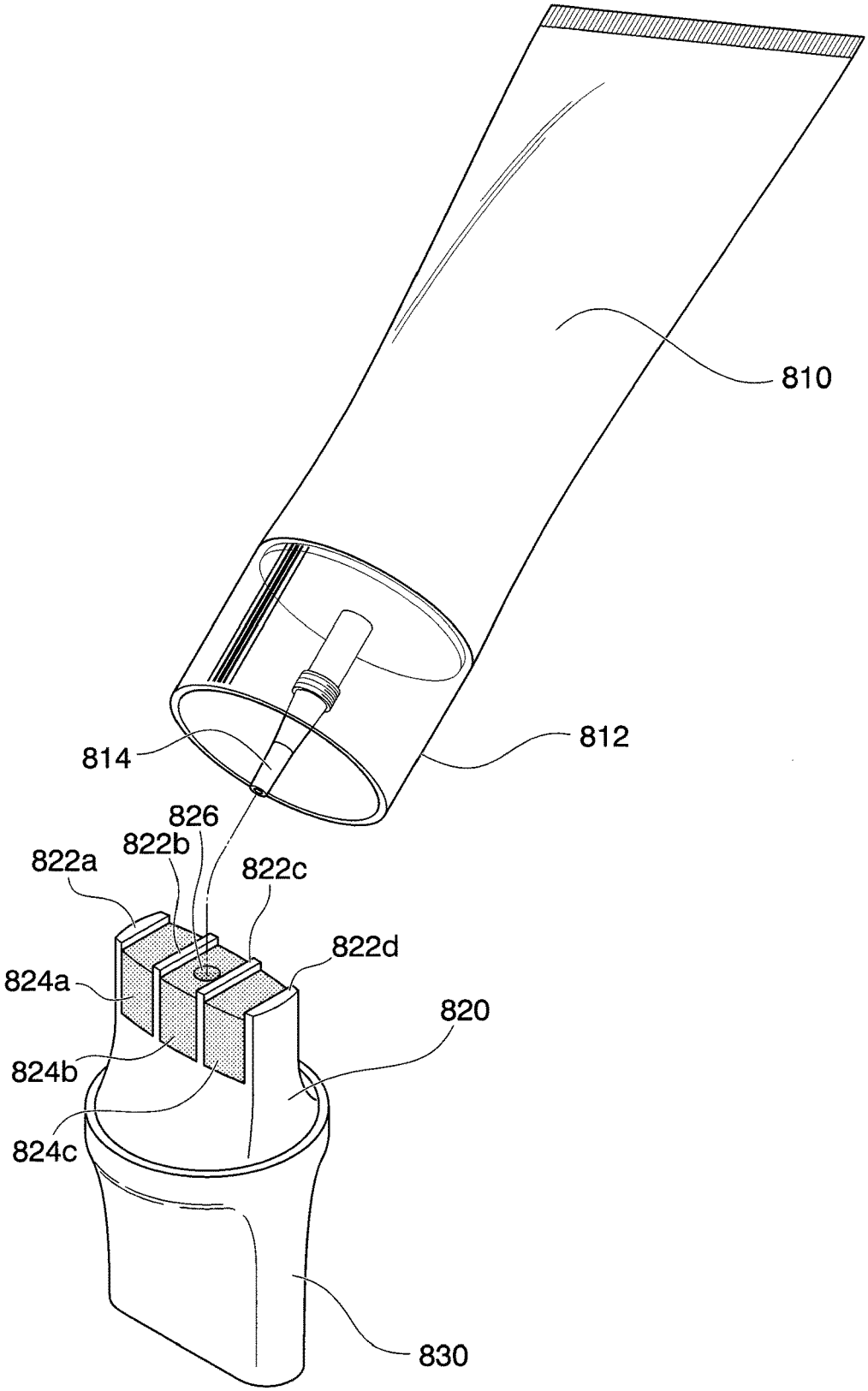
FIG. 17 illustrates the packaging shown in FIG. 16 in a state in which the cap with applicator is separated from the container.

FIGS. 16 and 17 illustrate an alternative embodiment of the present invention related to a packaging for a hair dye during storage (non-use) and during use. A packaging 800 illustrated in FIGS. 16 and 17 includes a tube-shaped container 810 in which a hair dye is accommodated and a cap 830 equipped with an applicator 820 used to apply the hair dye. The container 810 further includes a cylindrical collar 812.

The applicator 820 includes a plurality of fins 822*a* to 822*d*. However, the number, shape, arrangement, etc. of the fins are not limited to those of the illustrated embodiment. The applicator 820 further includes blocks 824*a* to 824*c* attached between adjacent fins 822*a* to 822*d*. These blocks 824*a* to 824*c* can be made from an absorbent material, such as a sponge or the like. The hair dye is loaded onto the surface of the blocks 824*a* to 824*c* and then retained within the blocks 824*a* to 824*c*. A hole 826 for receiving a pin-shaped nozzle 814 of the container 810 is formed in the block 824*b* positioned in the center.

During use, the user loads a desired amount of the hair dye onto the surface of the blocks 824*a* to 824*c* disposed between the fins 822*a* to 822*d* of the applicator 820 by pushing the side surfaces of the container 810. Next, the user applies the hair dye loaded onto the applicator 820 to their own hair of the hair of another person. During storage of the packaging, the applicator 820 is in a state in which it is completely fitted to the collar 812 of the container 810 as shown in FIG. 16.

Figure 18:
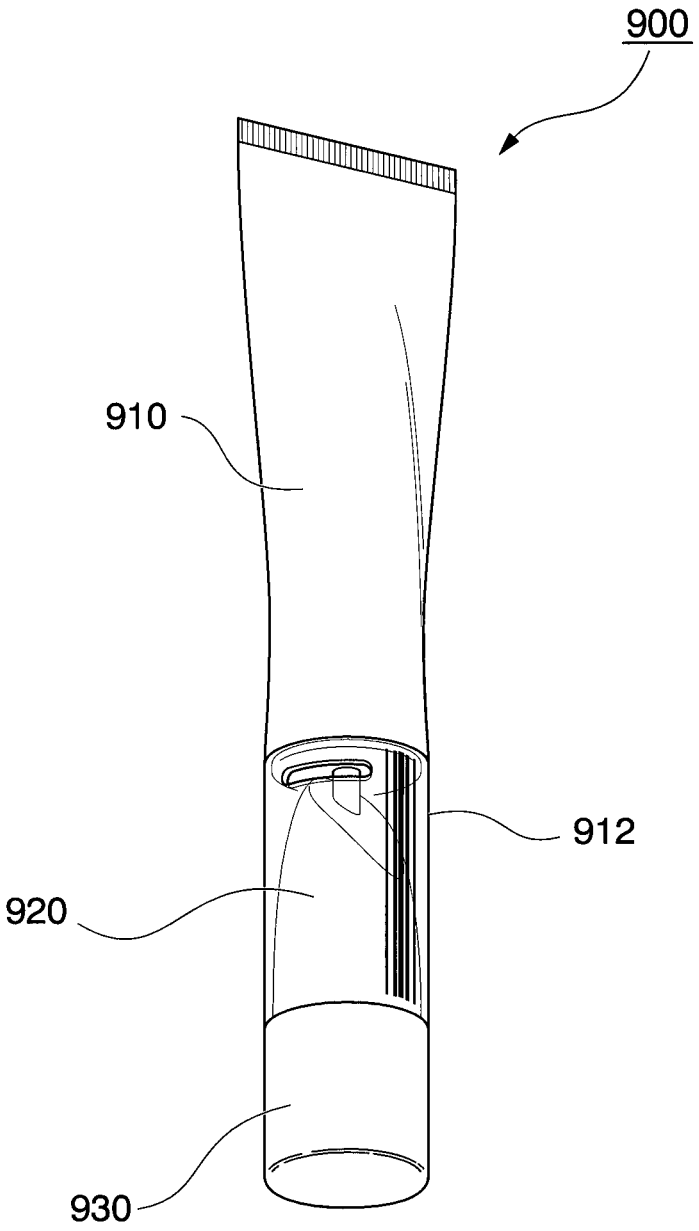
FIG. 18 is a perspective view of an alternative embodiment of the packaging according to the present invention, in which a cap with applicator is attached to a container.
Figure 19:
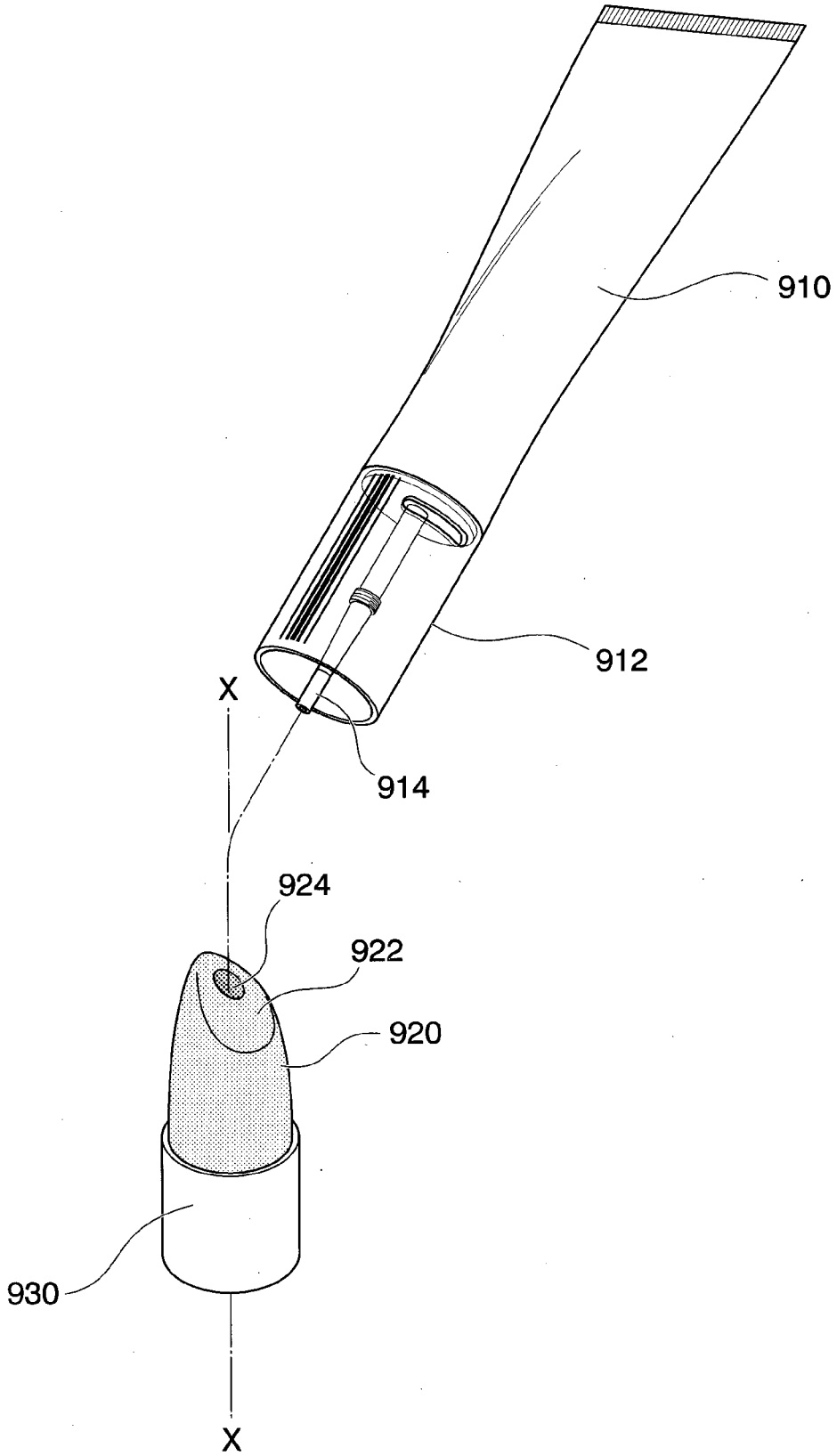
FIG. 19 illustrates the packaging shown in FIG. 18 in a state in which the cap with applicator is separated from the container.

FIGS. 18 and 19 illustrate an alternative embodiment of the present invention related to a packaging for a lip paint during storage (non-use) and during use. A packaging 900 illustrated in FIGS. 18 and 19 includes a tube-shaped container 910 in which a lip paint is accommodated and a cap 930 equipped with an applicator 920 used to apply the lip paint. The container 910 further includes a cylindrical collar 912.

The applicator 920 copies the shape of a general lip stick. In particular, the lip stick-shaped applicator 920 includes an application surface 922 that is inclined relative to a center axis X-X of the cap 930. As can be understood from FIG. 19, the applicator 920 includes a hole 924 for receiving a pin-shaped nozzle 914 of the container 910. During use, the user loads a desired amount of the lip paint onto the application surface 922 of the applicator 920 by pushing the side surfaces of the container 910. During storage of the packaging, the nozzle 914 is screwed into the cap 930, and the applicator 920 is in a state in which it is completely fitted to the collar 912 of the container 910 as shown in FIG. 18.

Figure 20:
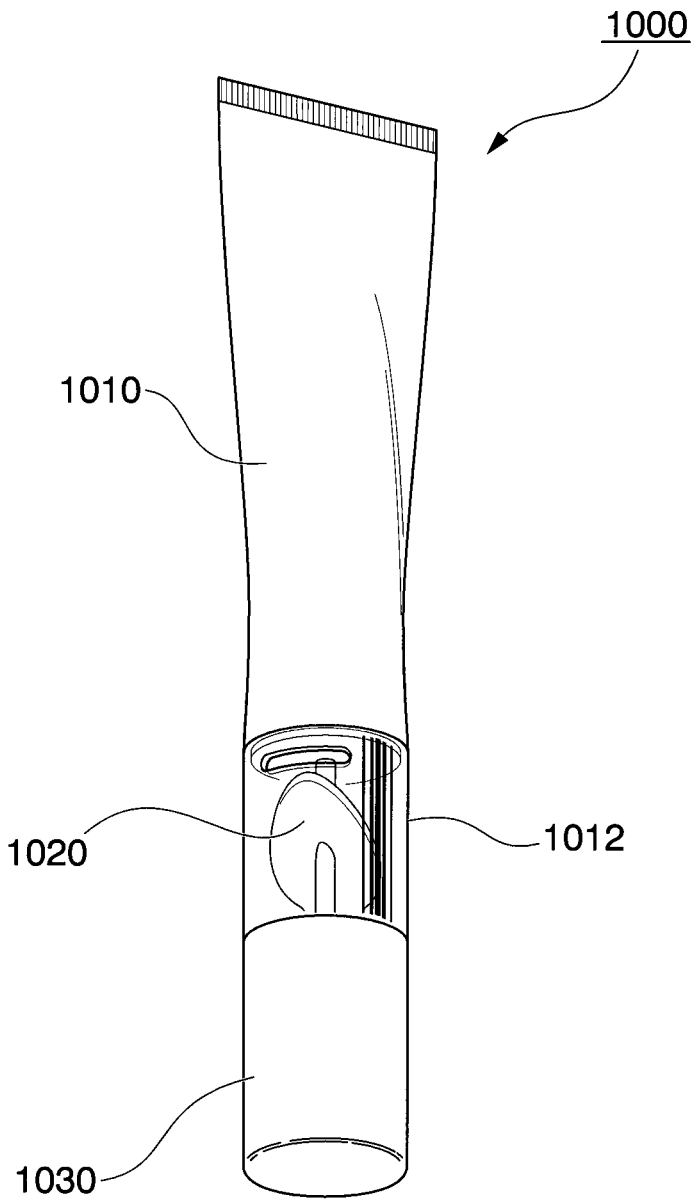
FIG. 20 is a perspective view of an alternative embodiment of the packaging according to the present invention, in which a cap with applicator is attached to a container.
Figure 21:
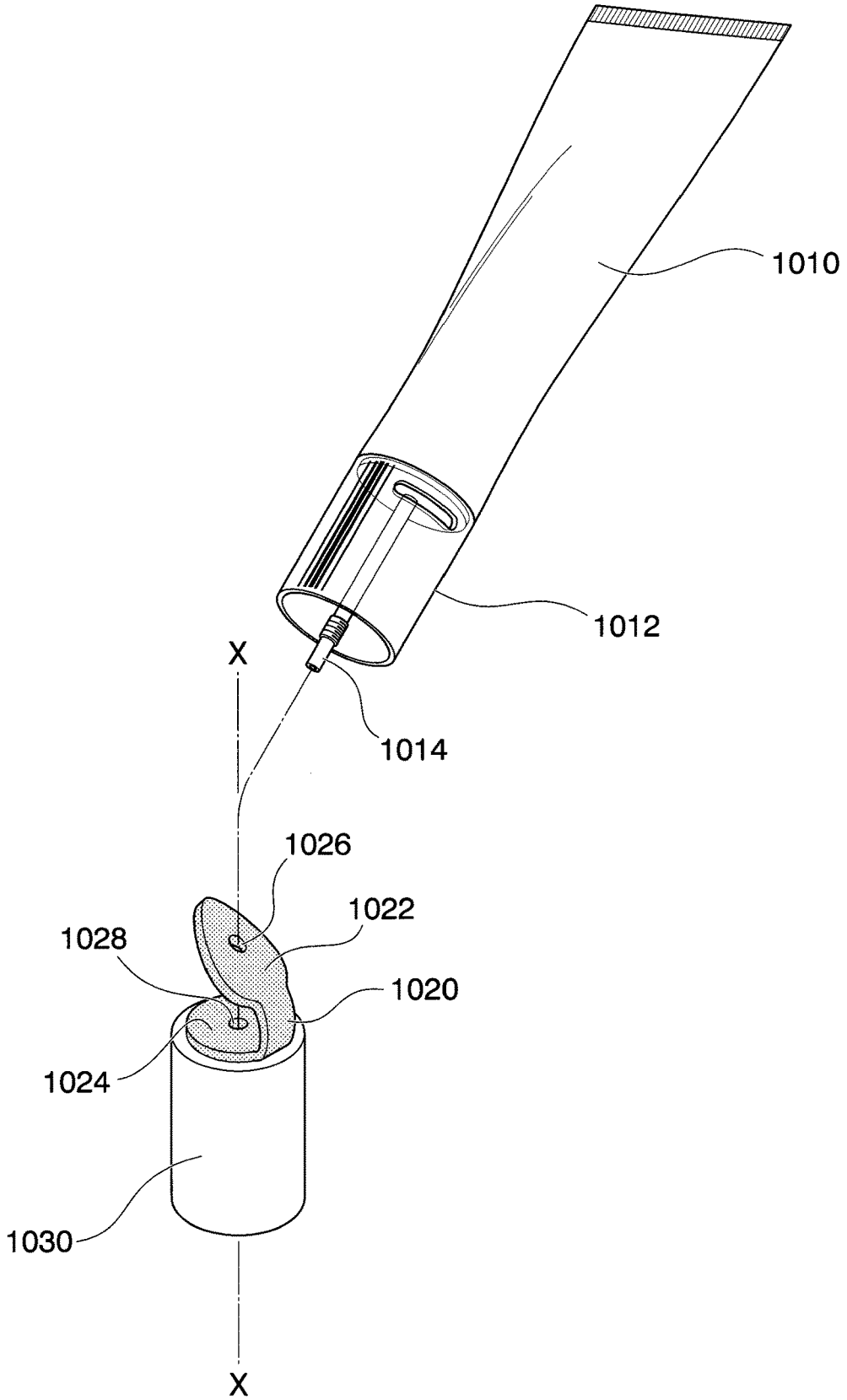
FIG. 21 illustrates the packaging shown in FIG. 20 in a state in which the cap with applicator is separated from the container.

FIGS. 20 and 21 illustrate an alternative embodiment of the present invention related to a packaging for an eye shadow during storage (non-use) and during use. A packaging 1000 illustrated in FIGS. 20 and 21 includes a tube-shaped container 1010 in which an eye shadow is accommodated and a cap 1030 equipped with an applicator 1020 used to apply the eye shadow. The container 1010 further includes a cylindrical collar 1012.

The applicator 1020 is in the form of a spatula made of, for example, a soft plastic. The spatula-shaped applicator 1020 includes an application surface 1022 that is inclined relative to a center axis X-X of the cap 1030 and a base surface 1024 that is orthogonal to the axis X-X. The application surface 1022 and the base surface 1024 of the applicator 1020 respectively include holes 1026 and 1028 for receiving a pin-shaped nozzle 1014 of the container 1010.

During use, as shown in FIG. 21, the user separates the cap 1030 from the container 1010. Next, the user loads a desired amount of eye shadow onto the application surface 1022 of the applicator 1020 by pushing the side surfaces of the container 1010. During storage of the packaging, the nozzle 1014 is screwed into the cap 1030, and the applicator 1020 is in a state in which it is accommodated in a space within the collar 1012 of the container 1010 as shown in FIG. 20.

Figure 22:
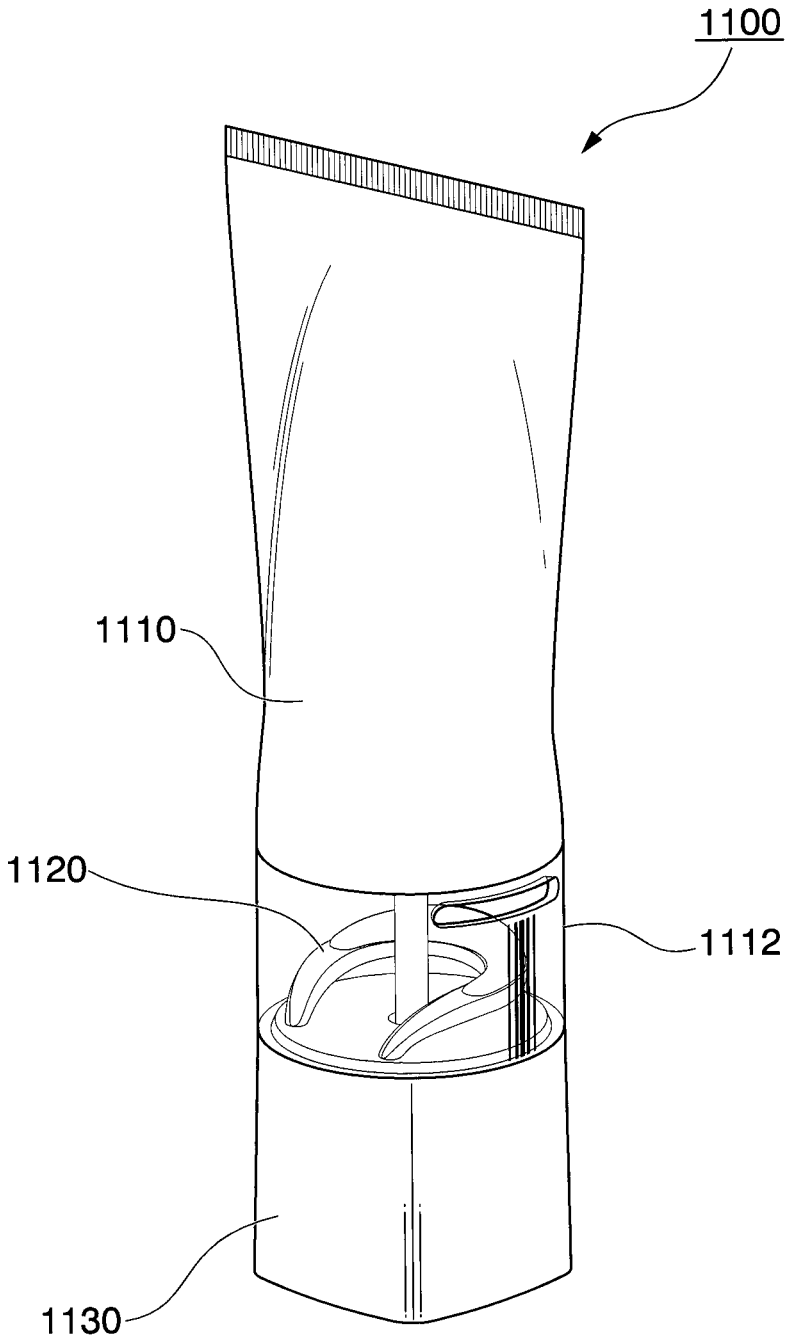
FIG. 22 is a perspective view of an alternative embodiment of the packaging according to the present invention, in which a cap with applicator is attached to a container.
Figure 23:
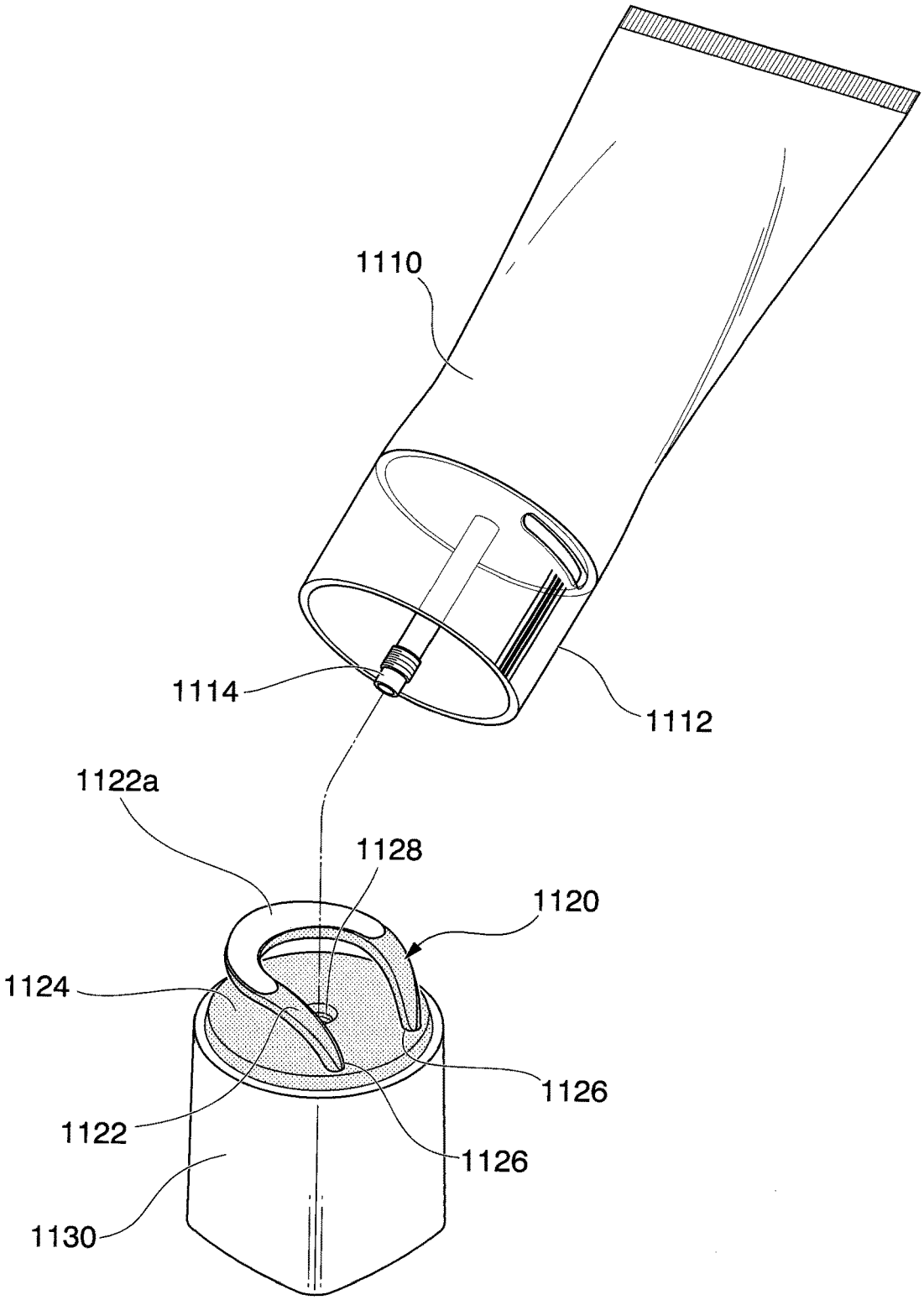
FIG. 23 illustrates the packaging shown in FIG. 22 in a state in which the cap with applicator is separated from the container.

FIGS. 22 and 23 illustrate an alternative embodiment of the present invention related to a packaging for an eye cream during storage (non-use) and during use. A packaging 1100 illustrated in FIGS. 22 and 23 includes a tube-shaped container 1110 in which an eye cream is accommodated and a cap 1130 equipped with an applicator 1120 used to apply the eye cream. The container 1110 further includes a cylindrical collar 1112.

In this embodiment, the applicator 1120 includes a main body 1122 in the form of a horse shoe, and a base 1124. The main body 1122 is disposed on the base 1124 such that it inclines at an angle to a surface of the base 1124. The main body 1122 and the base 1124 are integrally made of, for example, a soft plastic. Therefore, flexible hinges 1126 are formed at two connections between the main body 1122 and the base 1124. At a free end of the main body 1122, a ridge 1122*a* in the "C" form is formed, the surface of which is preferably plated. This surface of the ridge 1122*a* acts as an application surface of the applicator 1120. Due to the existence of the flexible hinges 1126, when a force is applied to the application surface of the applicator 1120, the main body 1122 can tilt toward the base 1124. The base 1124 is joined to the cap 1130 and includes a hole 1128 for receiving a pin-shaped nozzle 1114 of the container 1110, as shown FIG. 23.

During use, as shown in FIG. 23, the user separates the cap 1130 from the container 1110. Next, the user loads a desired amount of eye cream onto the application surface of the applicator 1120 by pushing the side surfaces of the container 1110. During storage of the packaging, the nozzle 1114 is screwed into the cap 1130, and the applicator 1120 is in a state in which it is accommodated in a space within the collar 1112 of the container 1110 as shown in FIG. 22.

Figure 24:
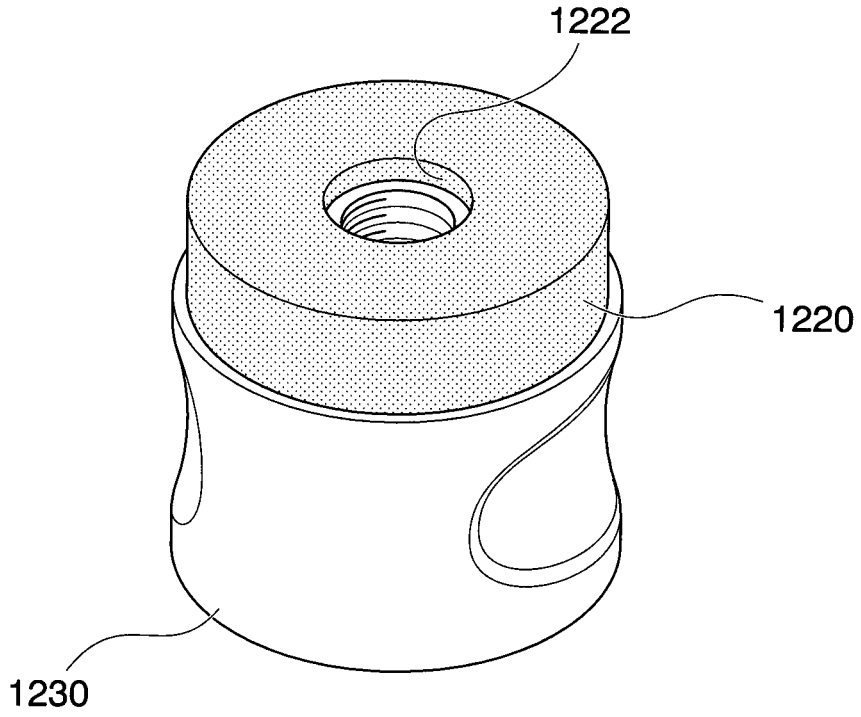
FIG. 24 is a perspective view of an alternative embodiment of the applicator with the cap according to the present invention.

According to a further alternative embodiment, the applicator itself can be made from a solid formula. FIG. 24 illustrates a cap 1230 in which an applicator 1220 is made from, for example, a soap. A hole 1222 for receiving a nozzle (not illustrated) of the container to which the cap 1230 is attached can be formed in the applicator 1220. During use, a formula accommodated within the container (not illustrated) or water is loaded onto the soap which forms the applicator 1220.

Further, according to another embodiment, the applicator can be protected behind a part such as a grid. According to another embodiment, the applicator can be configured to rotate or oscillate using a drive means such as a motor or without using a drive means. According to another embodiment, the applicator can have a heating or cooling function. According to another embodiment, the applicator can have a rough surface in order to obtain a good massage effect or soaking effect. According to another embodiment, the applicator can be a "multi-applicator". According to another embodiment, the applicator can be a delimited area of the cap. According to another embodiment, the nozzle for discharging the formula can exist at a location other than the center of the container. According to another embodiment, a pin which has the size and shape corresponding to those of the opening of the nozzle for discharging the formula can be formed on the applicator or the cap. In this case, when the cap is attached to the container, this pin will enter into the opening of the nozzle, thereby plugging the opening of the nozzle.

Various embodiments of the present invention have been explained with reference to the drawings. However, the present invention is not limited to these embodiments. The various features of the above-described embodiments can be combined together as long as such combination is possible in principle. Various corrections, modifications, and other embodiments would be obvious to those skilled in the art. Any such corrections, modifications, and other embodiments are included within the category of the present invention.

The invention claimed is:

1. A device for accommodating a formula, the device comprising:

a container which accommodates the formula;

a nozzle for discharging the formula to the outside of the container;

a cap attached to the container, wherein the cap is capable of plugging an opening of the nozzle; and an applicator for applying the formula, wherein, the applicator is isolated from the formula so that it does not contact the formula within the container when the cap is attached to the container, and the applicator comprises a hole which receives at least a portion of the nozzle when the cap is attached to the container.

2. The device according to claim 1, wherein the applicator is attached to the cap such that the applicator can be separated from the cap.

3. The device according to claim 1, wherein the container comprises a collar surrounding the nozzle, the cap is attached to the container, and at least a portion of the applicator is accommodated within a space defined by the collar.

4. The device according to claim 1, wherein an outer peripheral surface of the nozzle comprises screw threads, and the cap comprises screw threads that engage with the screw threads of the nozzle, and wherein when the cap is attached to the container, the screw threads of the nozzle can engage with the screw threads of the cap.

5. The device according to claim 1, wherein the applicator comprises a circular cross-section or non-circular cross-section chosen from an elliptical cross-section, a substantially triangular cross-section, a substantially square cross-section, and a substantially polygonal cross-section having at least five sides.

6. The device according to claim 5, wherein a cross-section area of the applicator decreases from a base side thereof toward a tip side thereof along a center axis (X-X) of the cap.

7. The device according to claim 1, wherein the applicator comprises an application surface that is inclined relative to the center axis of the cap.

8. The device according to claim 1, wherein the applicator is made of at least one material chosen from rubber, soft or hard plastic, sponge, or foam.

9. The device according to claim 1, wherein the applicator is made of a solid formula.

10. The device according to claim 1, wherein the applicator is a brush.

11. The device according to claim 1, wherein the applicator comprises a plurality of fins with spaces formed between the fins for retaining the formula.

12. The device according to claim 1, wherein the applicator is a spatula.

13. The device according to claim 1, wherein the applicator is a delimited area of the cap.

* * * * *